US007056150B2

(12) United States Patent
Saka et al.

(10) Patent No.: US 7,056,150 B2
(45) Date of Patent: Jun. 6, 2006

(54) ELECTRICAL CONNECTOR BOX

(75) Inventors: Yukinori Saka, Yokkaichi (JP); Kouichi Okada, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 11/090,043

(22) Filed: Mar. 28, 2005

(65) Prior Publication Data

US 2005/0221689 A1 Oct. 6, 2005

(30) Foreign Application Priority Data

Mar. 30, 2004 (JP) ..... 2004-098388

(51) Int. Cl.
*H01R 31/08* (2006.01)

(52) U.S. Cl. ..... 439/511; 439/680

(58) Field of Classification Search ..... 439/511, 439/680, 512, 587, 507
See application file for complete search history.

(56) References Cited

U.S. PATENT DOCUMENTS

| | | | | |
|---|---|---|---|---|
| 3,054,078 | A * | 9/1962 | Baschkin | 439/44 |
| 4,030,793 | A * | 6/1977 | Hanlon et al. | 439/189 |
| 4,090,667 | A * | 5/1978 | Crimmins | 439/189 |
| 4,689,718 | A * | 8/1987 | Maue et al. | 361/686 |
| 5,000,699 | A * | 3/1991 | Nadin | 439/511 |
| 5,040,996 | A * | 8/1991 | Kobold et al. | 439/76.2 |
| 5,201,667 | A * | 4/1993 | Endo et al. | 439/189 |
| 5,321,203 | A * | 6/1994 | Goto et al. | 174/48 |
| 5,586,908 | A * | 12/1996 | Lorrain | 439/511 |
| 5,722,862 | A * | 3/1998 | Glathe et al. | 439/709 |
| 6,846,204 | B1 | 1/2005 | Oda | |
| 6,851,956 | B1 | 2/2005 | Saka et al. | |
| 2004/0029420 | A1 | 2/2004 | Yamaguchi | |

FOREIGN PATENT DOCUMENTS

| | | |
|---|---|---|
| JP | 1- 107882 | 7/1989 |
| JP | 7- 153527 | 6/1995 |

OTHER PUBLICATIONS

English Language Abstract of JP 7-153527.
U.S. Appl. No. 11/092,710 to Saka, filed Mar. 30, 2005.
U.S. Appl. No. 11/092,726 to Saka, filed Mar. 30, 2005.

* cited by examiner

*Primary Examiner*—Hien Vu
(74) *Attorney, Agent, or Firm*—Greenblum & Bernstein, P.L.C.

(57) ABSTRACT

An electrical connector box constructed to prevent inaccurate insertion of a short circuit forming terminal to the contacts of an internal circuit. A shorting terminal includes a conductor plate having multiple tabs extending from a link portion, the link portion being covered by a cover, and a post that extends in the same direction as the tabs. A relay receptacle includes a post aperture into which post member of cover is inserted, thus allowing the tabs to enter specified terminal slots of the relay receptacle.

12 Claims, 9 Drawing Sheets

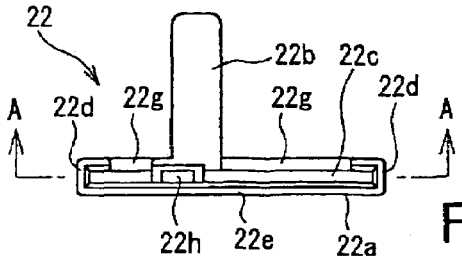
FIG.6A
FIG.6B
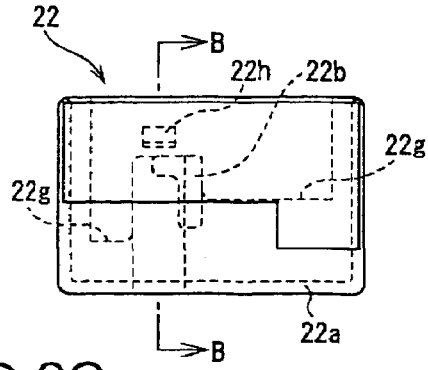
FIG.6C
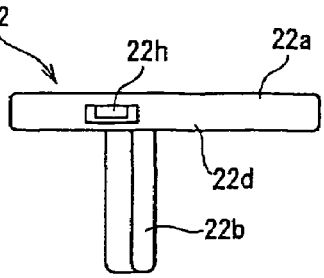
FIG.6D
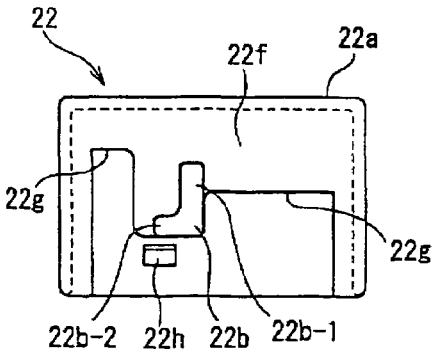
FIG.6E
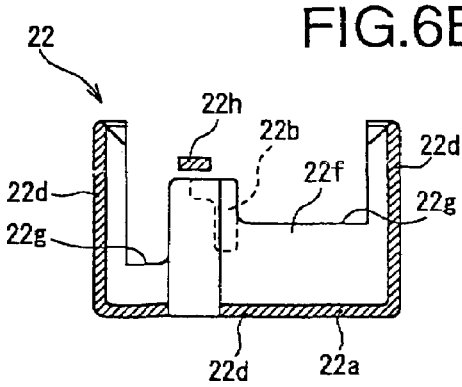
FIG.6F
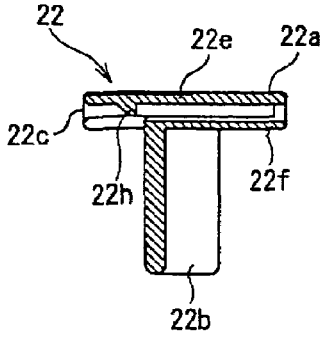

ELECTRICAL CONNECTOR BOX

CROSS REFERENCE TO RELATED APPLICATIONS

The present disclosure relates to subject matter contained in priority Japanese Application No. 2004-098388, filed on Mar. 30, 2004, which is herein expressly incorporated by reference in its entirety.

BACKGROUND OF THE INVENTION

1. Field of the Invention

The invention relates to an electrical connector box, and in particular to an electrical connector box constructed to prevent inaccurate insertion of a circuit shorting terminal into the terminal slots of a relay receptacle formed on the external surface of a case.

2. Description of Related Art

The internal circuits of an automotive electrical connector box are conventionally constructed in various configurations for use with various types of automobiles and various grades of automobiles within a model line. For example, when the internal circuit is formed from a bus bar that has been blank-formed to a required shape, the manufacture of each internal circuit requires that a different bus bar pattern be fabricated for use with each type of internal circuit.

However, fabricating a bus bar pattern for each of the internal circuits creates problems such as the need to configure insertion elements for each bus bar pattern, and an increase in cost, in certain cases, due to the need to fabricate various dies. Also, an increase in the number of bus bar configurations can become difficult to manage.

Japanese Utility Model Patent No. H1-107882 describes a circuit shorting structure using a relay receptacle. As shown by the two circuits in FIGS. 9A and 9B, tabs 1 through 4 extend toward the bus bar of the internal circuit and connect to relay terminals. This structure is applicable when the electrical connector box does not require that tabs 1 and 2 be shorted. However, for electrical connector boxes that require tabs 1 and 2 to be shorted, shorting terminal 5 to be connected to the wrong bus bar tabs 3 and 4, thus leading to the unintended shorting of bus bars.

SUMMARY OF THE INVENTION

The present invention resolves the shortcomings of the prior art through an electrical connector box constructed to allow the formation of a shorted circuit through the connection of a shorting terminal to the contact parts of an internal circuit in a manner that prevents the connection of the shorting terminal to the wrong contacts of the internal circuit.

An aspect of the present invention provides an electrical connector box including a shorting terminal having a plurality of tabs projecting therefrom, the tabs configured to insert into specified terminal slots of a relay receptacle provided on a case surface of the electrical connector box and to connect to a contact circuit within the case to form a shorted circuit; a post member projecting from the shorting terminal in substantially the same direction as the tabs; and a post aperture provided in the relay receptacle; wherein insertion of the post member into the post aperture allows the tabs to be inserted only into specified terminal slots of the relay receptacle.

In a further aspect of the present invention, the shorting terminal includes a conductor plate including a link portion, the plurality of tabs projecting from the link portion; and a cover covering the link portion; wherein the post member extends from the cover in substantially the same direction as the tabs. Further, the post member may project beyond the tabs. The link portion may attach to the cover through a locking mechanism. Further, the post aperture is rectangular in shape and the post member is rectangular in cross section, such that the post member cannot be inserted into the post aperture if rotated 90 degrees. The post aperture may be L-shaped in cross section, such that the post member cannot be inserted into the post aperture if rotated 90 degrees.

In a further aspect of the present invention, the cover is formed of an insulating synthetic resin. Further, the link portion of the shorting terminal is mold formed therein. The shorting terminal may further include a conductor plate including a link portion, the plurality of tabs projecting from the link portion; and a cover covering the link portion; wherein the post member is a bend formed member projecting from the link portion in substantially the same direction as the plurality of tabs.

A further aspect of the present invention provides a shorting terminal including a plurality of tabs projecting therefrom, the tabs configured to insert into specified terminal slots of a relay receptacle provided on a case surface of an electrical connector box and to connect to a contact circuit within the case to form a shorted circuit; and a post member projecting from the shorting terminal in substantially the same direction as the tabs; wherein insertion of the post member into a post aperture provided in the relay receptacle allows the tabs to be inserted only into specified terminal slots of the relay receptacle.

This structure of the present invention provides a shorting terminal on which a post member is formed extending in the same direction as the tabs, and a relay receptacle, on which a post aperture is formed, housing a contact circuit that may be shorted through the shorting terminal. Therefore, the attempted insertion of the tabs of the shorting terminal into the specified terminal slots in the relay receptacle results in the shorting terminal post part entering the post aperture in the relay receptacle, thus allowing the tabs to enter specified terminal slots. Conversely, when an attempt is made to insert the shorting terminal into a relay receptacle having an internal circuit not designed to be shorted, the post member contacts the face of the relay receptacle and prevents the tabs from entering the terminal slots. This structure allows the tabs of the shorting terminal to be inserted only into the specified terminal slots of a relay receptacle, and thus makes it possible to prevent the tabs from being mistakenly inserted into the wrong terminal slots of the relay receptacle. The structure of the present invention also makes it possible to prevent the tabs from being mistakenly inserted in an incorrect relay receptacle.

Further, the construction of present invention provides a cover to protect the shorting terminal. Furthermore, forming the post member from synthetic resin allows it to be fabricated to any desired size, shape, strength or other attribute.

It is preferable that the post part extend farther outward than the tabs. With this structure, an attempt to insert the shorting terminal into the wrong relay receptacle results in the post part contacting the face of the relay receptacle before the tabs can enter the terminal slots, thus preventing the tabs from coming into contact with the contact circuit in the case, and thus dependably preventing the formation of a short circuit. The present invention, in which the link portion of the shorting terminal attaches to the cover through a locking joint, or by being molded therein, allows simple fabrication of the shorting terminal. Moreover, the conductor plate of the shorting terminal may be used in the same manner as a conventional shorting terminal.

Furthermore, when short circuits are to be formed at multiple locations, while the shorting terminals must be separately fabricated to accommodate each contact circuit, various types of conductor plates may be attached to the same type of cover through a locking joint or by being molding therein.

As previously noted, the invention provides for a shorting terminal from which a post part extends in the same direction as tabs, and a post hole formed within a relay receptacle within which a contact circuit is shorted through the shorting terminal. Therefore, the tabs enter the specified terminal slots when an attempt is made to insert the tabs of the shorting terminal into the specified terminal slots of a relay receptacle. Conversely, because a post hole is not provided in a relay receptacle having an internal circuit not intended to be shorted, an attempt to insert the tabs of the shorting terminal into the terminal slots of said relay receptacle results in the post part of the shorting terminal contacting the face of the relay receptacle, thereby preventing the tabs from entering the terminal slots. This structure allows the tabs of the shorting terminal to be inserted only into the specified terminal slots of a relay receptacle, and thus makes it possible to prevent the tabs from being mistakenly inserted into the wrong terminal slots of a relay receptacle.

BRIEF DESCRIPTION OF THE DRAWINGS

The above and other objects, features and advantages of the present invention will be made apparent from the following description of the preferred embodiments, given as non-limiting examples, with reference to the accompanying drawings, in which:

FIG. 6A is an inverted rear view of the cover according to the embodiment of FIG. 1;

FIG. 6B is a top plan view of the cover according to the embodiment of FIG. 1;

FIG. 6C is a front elevational view of the cover according to the embodiment of FIG. 1;

FIG. 6D is a bottom view of the cover according to the embodiment of FIG. 1;

FIG. 6E is a cross sectional view taken along line A—A in FIG. 6A of the cover according to the embodiment of FIG. 1;

FIG. 6F is a cross sectional view taken along line B—B in FIG. 6B of the cover according to the embodiment of FIG. 1;

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
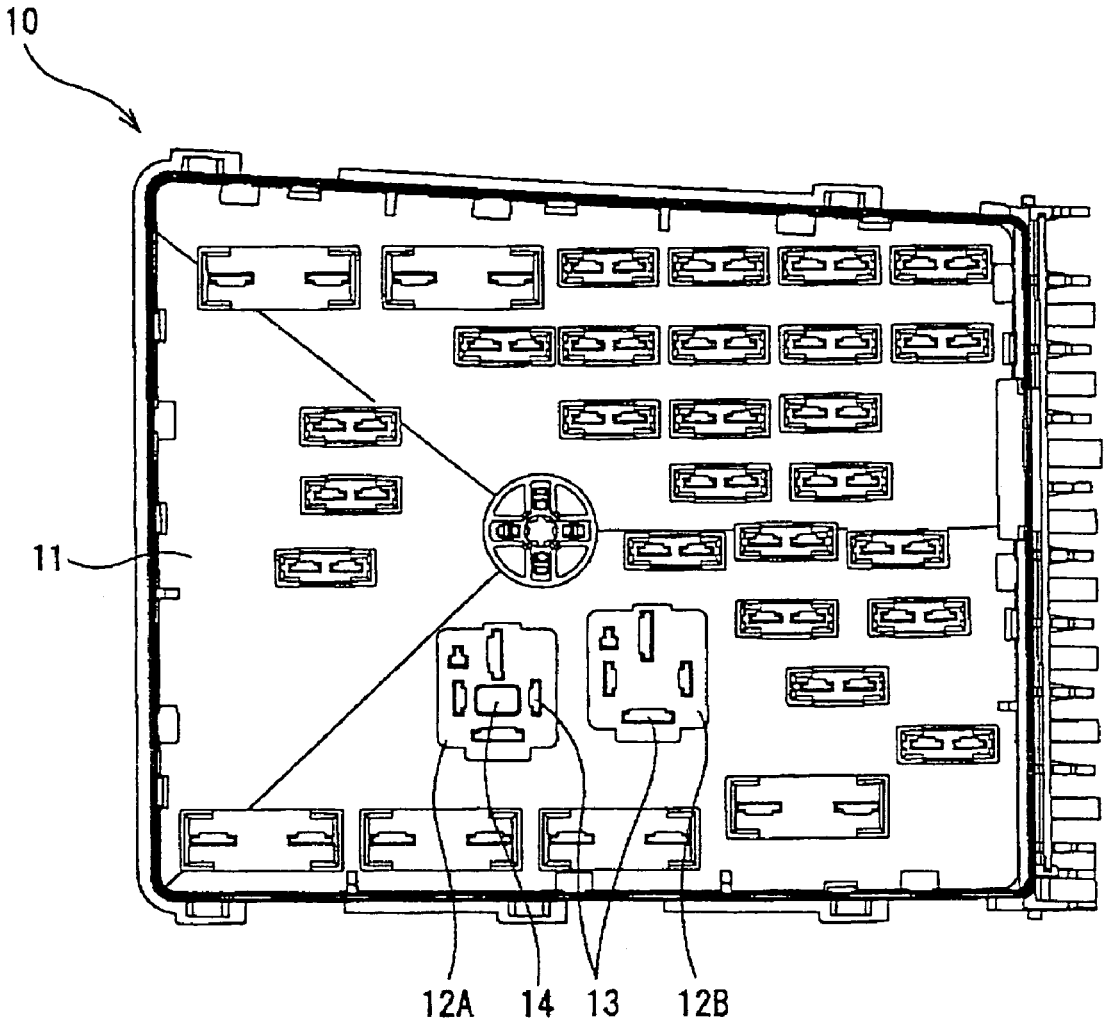
FIG. 1 is a top plan view of the electrical connector box according to an embodiment of the present invention.

The following describes embodiments of the present invention with reference to the drawings. FIGS. 1 though 8 show an embodiment of the present invention including electrical connector box 10 to which two relay receptacles, 12A and 12B, are provided on the external surface of upper case 11.

Figure 2A:
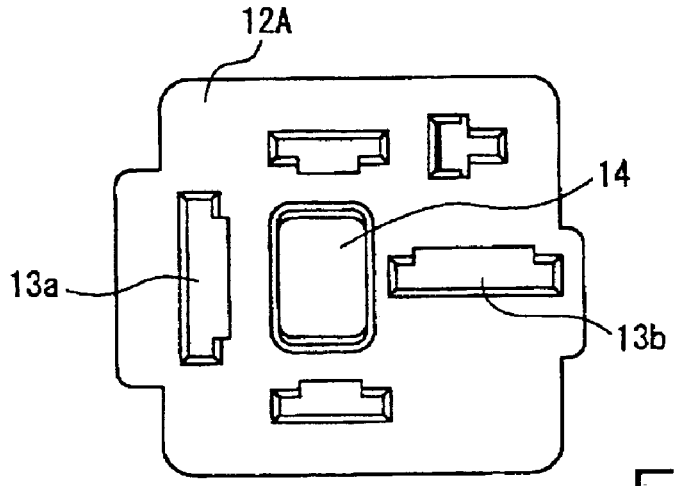
FIG. 2A is a top plan view of a relay receptacle to which the shorting terminal is to be attached according to the embodiment of FIG. 1.
Figure 2B:
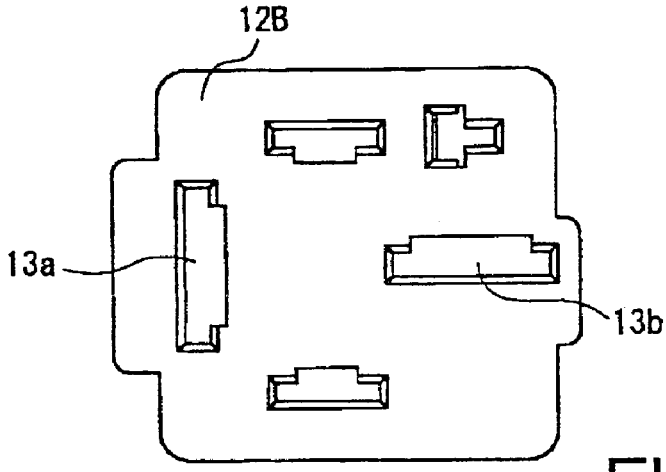
FIG. 2B is a top plan view of a relay receptacle to which a shorting terminal is not to be attached according to the embodiment of FIG. 1.
Figure 2C:
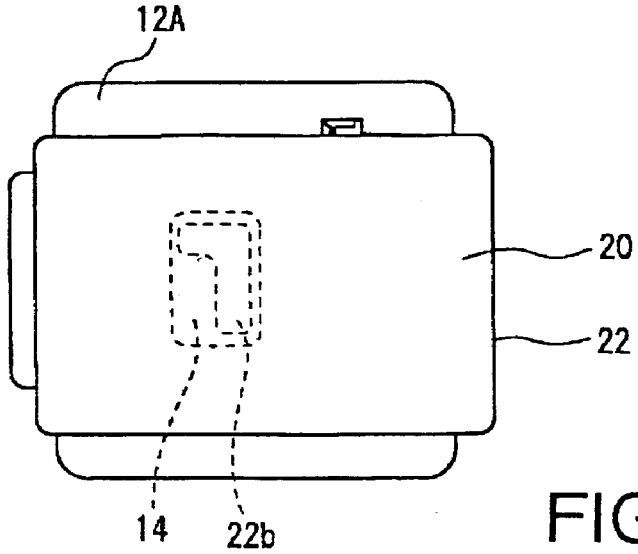
FIG. 2C is a top plan view of a relay receptacle to which the shorting terminal has been attached according to the embodiment of FIG. 1.
Figure 3:
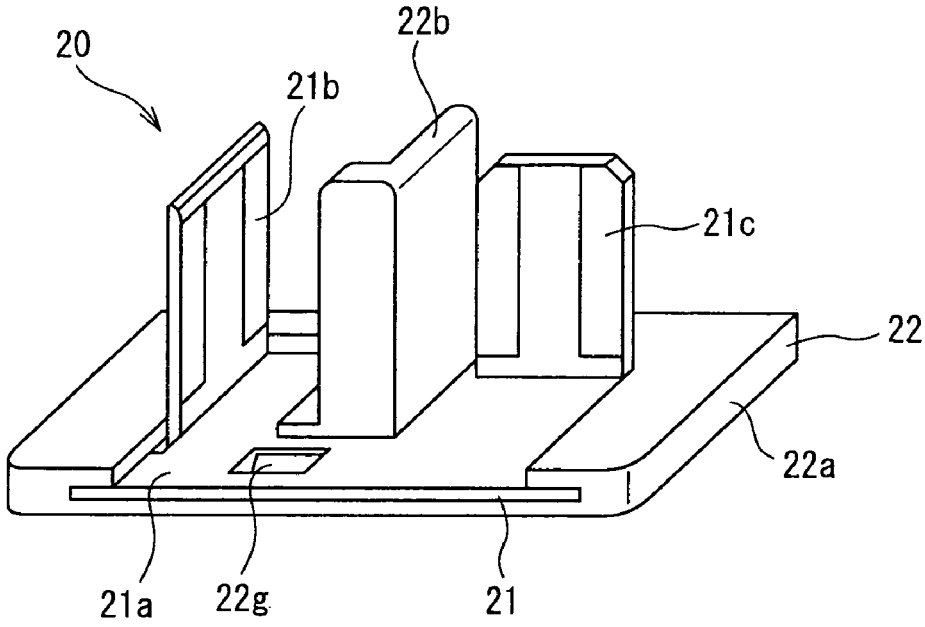
FIG. 3 is a perspective view of the shorting terminal according to the embodiment of FIG. 1.
Figure 4A:
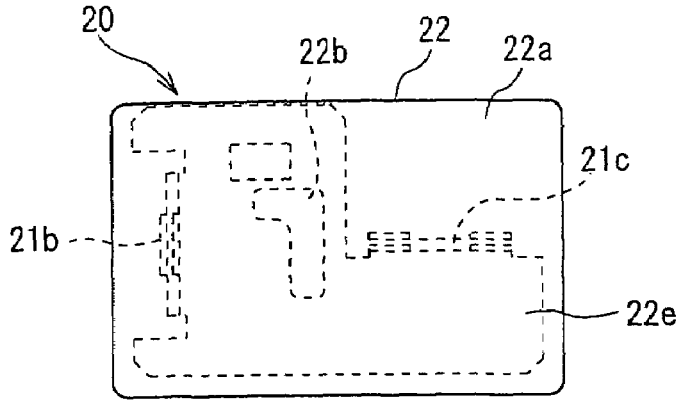
FIG. 4A is a top plan view of the shorting terminal according to the embodiment of FIG. 1.
Figure 4B:
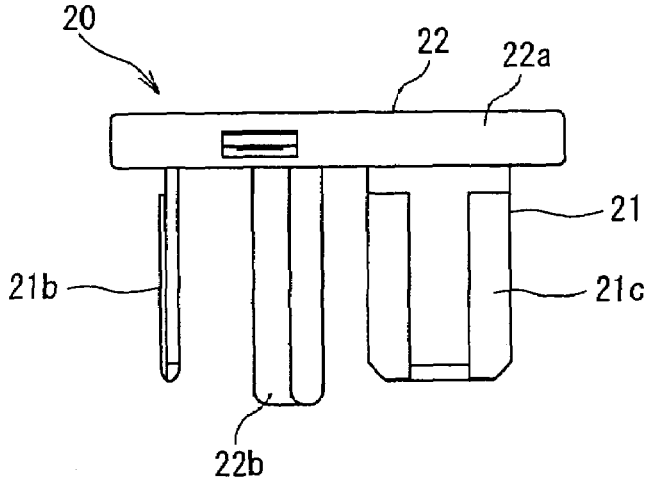
FIG. 4B is front elevational view of the shorting terminal according to the embodiment of FIG. 1.
Figure 4C:
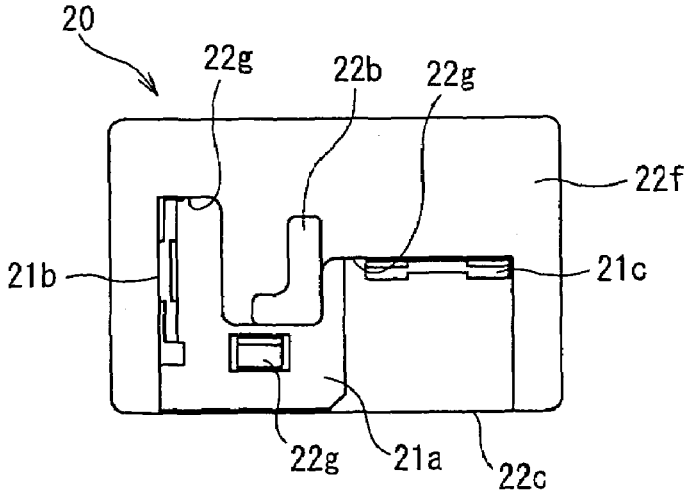
FIG. 4C is a bottom view of the shorting terminal according to the embodiment of FIG. 1.

As shown in FIG. 2A, relay receptacle 12A includes a post aperture 14 and multiple terminal slots 13*a*, 13*b* through which shorting terminal 20 is inserted, post aperture 14 being a centrally located hole surrounded by terminal slots 13*a*, 13*b*. The post aperture 14 may be of any suitable shape or configuration, and in the present embodiment has a rectangular shape. As shown in FIG. 2B, relay receptacle 12B includes terminal slots 13*a*, 13*b* formed therein in the same configuration as relay receptacle 12A noted above. Relay receptacle 12B, however, does not include a post aperture.

Figure 7A:
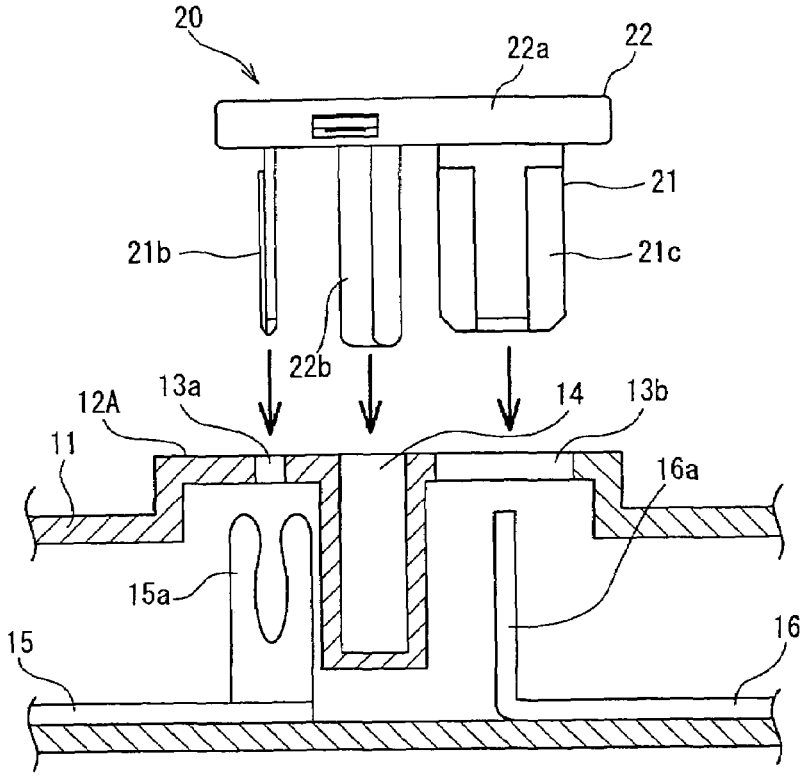
FIG. 7A shows the shorting terminal and a specified relay receptacle prior to attachment according to the embodiment of FIG. 1.
Figure 7B:
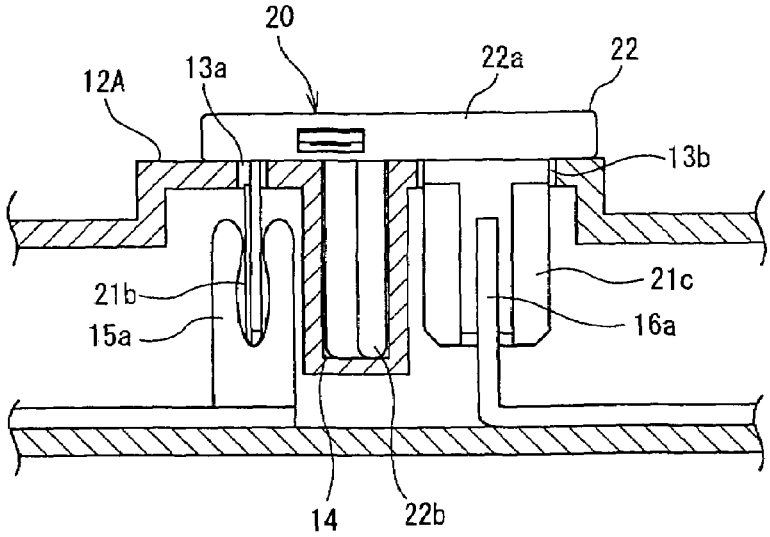
FIG. 7B shows the shorting terminal and a specified relay receptacle after attachment according to the embodiment of FIG. 1.
Figure 8:
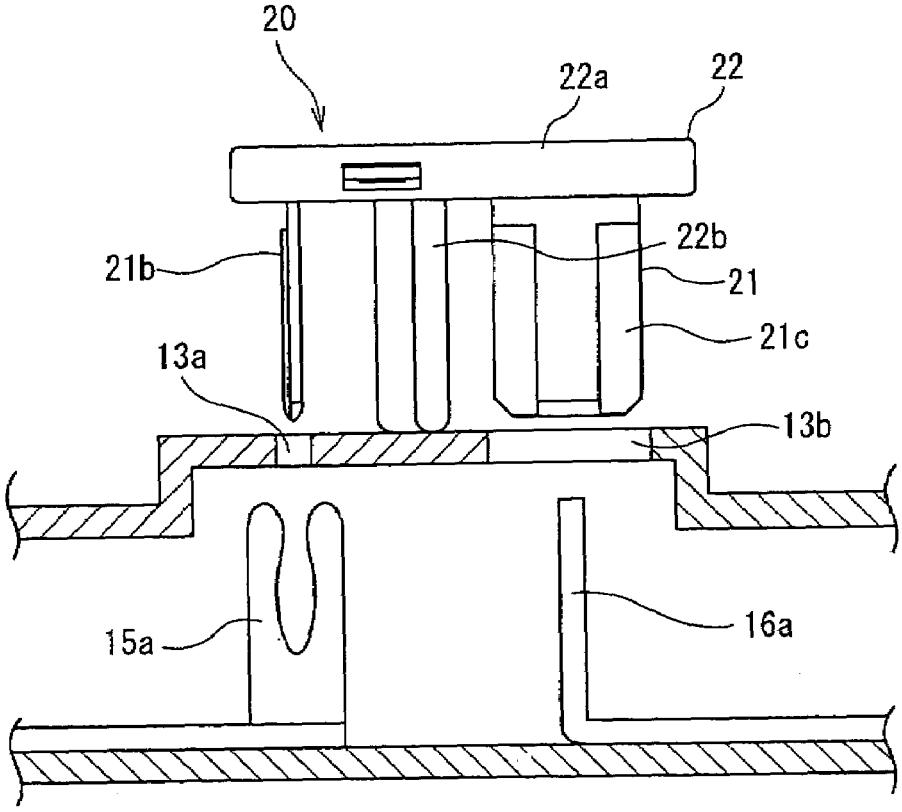
FIG. 8 shows the shorting terminal and an unspecified relay receptacle unable to attach according to the embodiment of FIG. 1.
Figure 9A:
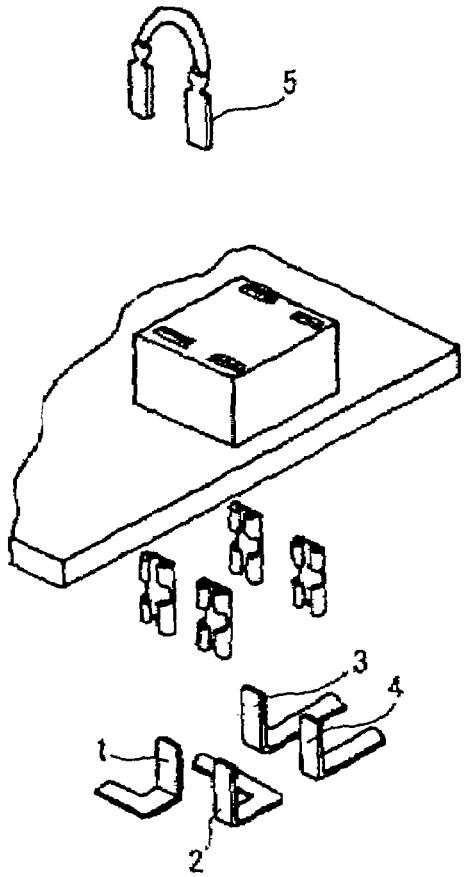
FIG. 9A is a perspective view of a circuit shorting device according to the prior art.
Figure 9B:
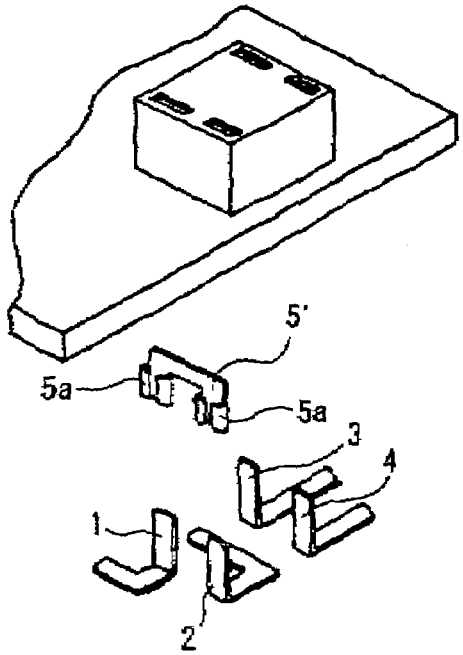
FIG. 9B is a perspective view of circuit shorting device according to the prior art.

Further, as illustrated in FIGS. 7A, 7B, and 8, bus bars 15 and 16, each being part of one of two electrically disconnected circuits, include friction connectors 15*a* and 16*a*, respectively, located in the interior region of the case beneath relay receptacles 12A and 12B. Friction connectors 15*a* and 16*a* are provided to make frictional connection to tabs 21*b*, 21*c* inserted through specifically located terminal slots 13*a* and 13*b*.

Figure 5A:
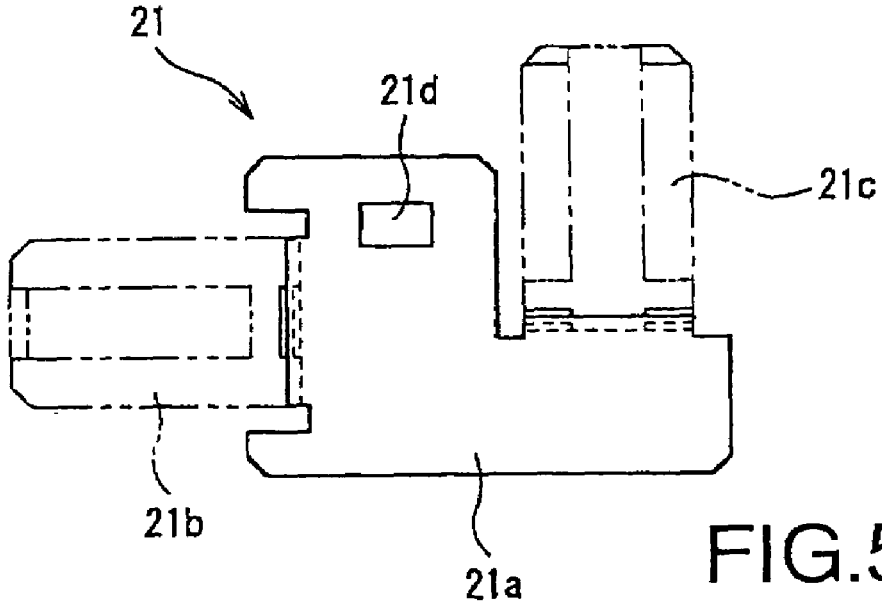
FIG. 5A is a top plan view of the conducting plate of the shorting terminal according to the embodiment of FIG. 1.
Figure 5B:
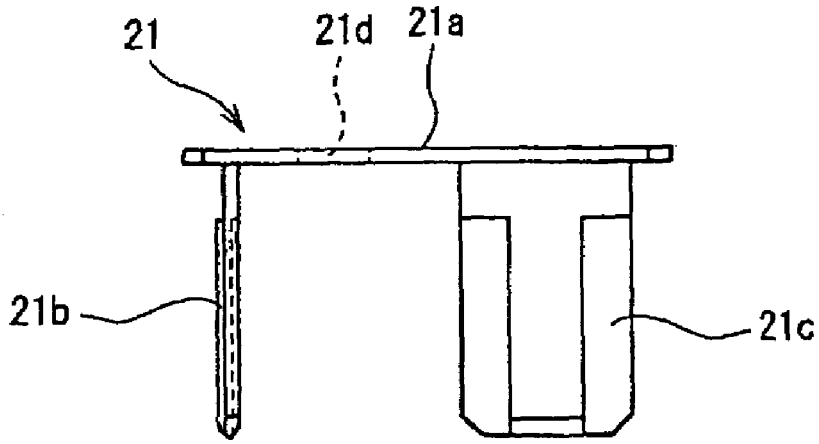
FIG. 5B is a front elevational view of the conducting plate of the shorting terminal according to the embodiment of FIG. 1.

Shorting terminal 20 includes conductor plate 21 which is inserted into relay receptacle 12A, and on which, as shown in FIG. 5, tabs 21*b* and 21*c* project from link portion 21*a* on planes that intersect at 90-degrees. Moreover, cover 22 is installed over link portion 21*a* by a latch finger 22*h* that is inserted into and locks to latch aperture 21*d* which is formed at a specific location within link portion 21*a*.

Cover 22, which is installed over link portion 21*a* of conductor plate 21, includes post member 22*b* which, as shown in FIGS. 6A–6F, is an L-shaped member in cross section, extending downward from floor plate 22*f*. Post member 22*b* includes long portion 22*b*-1 and short portion 22*b*-2 formed on a plane intersecting long portion 22*b*-1. The external surfaces of post member 22*b* conform and join to the internal surfaces of post aperture 14 of relay receptacle 12A. Therefore, post member 22*b* may be inserted into post aperture 14 when the long portion of post member 22*b* is placed in a position aligned with the long side of post aperture 14. Post member 22*b* cannot, however, be inserted into post aperture 14 when it has been turned 90-degrees from the correct position due to the long portion of the post member 22*b* opposing the short side of post aperture 14 and coming into contact with the wall part of relay receptacle 12A while in the 90-degree turned position. The cover and the parts thereof including the post member may be formed of any suitable material such as, for example, a synthetic resin.

Cover portion 22*a* of cover 22 is a thin box-like structure having open side 22*c* through which link portion 21*a* of conductor plate 21 is inserted into cover portion 22*a*. Side wall 22*d* and upper wall 22*e* of cover portion 22*a* enclose link portion 21*a*, thus preventing conductor plate 21 from being exposed to the external environment when shorting terminal 20 is installed into relay receptacle 12A. Cutout portion 22*g* is formed in floor plate 22*f*, from which post member 22*b* projects, and extends inward from open side 22*c*, thus providing an open portion from which tabs 21*b* and 21*c* of conductor plate 21 may project. Further, latch finger 22*h* is provided on the internal surface of upper wall 22*e* at a location opposing latch hole 21*d* formed in link portion 21*a* of conductor plate 21. Shorting terminal 20 is assembled by inserting conductor plate 21 into cover 22, thereby causing latch finger 22*h* to enter and lock within latch hole 21*d* in link portion 21*a*. In addition, when conductor plate 21 is secured within cover 22, post member 22*b*, which is formed on cover 22, may extend beyond tabs 21*b* and 21*c*.

As shown in FIG. 7*a*, the insertion of shorting terminal 20 into relay receptacle 12A, which contains internal circuits to be shorted, results in post member 22*b* entering post aperture 14 (which is formed as part of relay receptacle 12A), and tabs 21*b* and 21*c* of shorting terminal 20 entering terminal slots 13*a* and 13*b* and then frictionally connecting to friction connectors 15*a* and 16*b* of the internal circuits as shown in FIG. 7B. A shorted or completed circuit is thus formed between bus bars 15 and 16 through shorting terminal 20.

Conversely, as shown in FIG. 8, if an attempt is made to insert shorting terminal 20 into relay receptacle 12B in which there are terminals not intended for shorting, post member 22*b*, which is part of cover 22 of shorting terminal 20, comes into contact with the external surface of relay receptacle 12B, and thus cannot be inserted into the receptacle.

This structure allows tabs 21*b* and 21*c* of shorting terminal 20 to be inserted only into terminal slots 13*a* and 13*b* of a specified relay receptacle 12A, and thus prevents the insertion of shorting terminal 20 into the wrong relay receptacle.

While this embodiment has described the conductor plate of the shorting terminal as constructed to lock to the cover part, the link portion of the shorting terminal may also be provided in any suitable manner such as, for example, by molding into the cover part.

The post member, which is attached to the cover part, may be formed in any suitable manner such as, for example, in the same rectangular cross section as the post aperture in the relay receptacle, or formed as an angular "C" shape in cross section.

The number of tabs formed on the conductor plate of the shorting terminal is not limited to two, and may include any suitable number of terminals such as, for example, three or more.

Further, in an alternative embodiment, the post member may be constructed so as not to extend from the cover part, but to be a part of the conductor plate (which forms the shorting terminal) that has been bend-formed to project from the link portion in the same direction as the tabs.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. An electrical connector box comprising:

a shorting terminal having a plurality of tabs projecting therefrom, said tabs configured to insert into specified terminal slots of a relay receptacle provided on a case surface of the electrical connector box and to connect to a contact circuit within the case to form a shorted circuit;

an insulating post member projecting from said shorting terminal between the tabs and in substantially the same direction as said tabs; and a post aperture provided in said relay receptacle;

wherein insertion of said post member into said post aperture allows said tabs to be inserted only into specified terminal slots of said relay receptacle;

said shorting terminal comprising: a conductor plate including a link portion, said plurality of tabs projecting from said link portion; and a cover covering said link portion;

wherein said post member is integrally formed with said cover and extends from said cover in substantially the same direction as said tabs; and wherein said cover is formed of an insulating synthetic resin.

2. The electrical connector box according to claim 1, wherein said post member projects beyond said tabs.

3. The electrical connector box according to claim 1, wherein said link portion of said shorting terminal attaches to said cover through a locking mechanism.

4. The electrical connector box according to claim 1, wherein said post aperture is rectangular in shape and said post member is rectangular in cross section, such that said post member cannot be inserted into said post aperture if rotated 90 degrees.

5. The electrical connector box according to claim 1, wherein said post aperture is L-shaped in cross section, such that said post member cannot be inserted into said post aperture if rotated 90 degrees.

6. The electrical connector box according to claim 1, wherein said link portion of said shorting terminal is mold formed therein.

7. A shorting terminal comprising:

a plurality of tabs projecting therefrom, said tabs configured to insert into specified terminal slots of a relay receptacle provided on a case surface of an electrical connector box and to connect to a contact circuit within the case to form a shorted circuit; and an insulating post member projecting from said shorting terminal between the tabs and in substantially the same direction as said tabs;

wherein insertion of said post member into a post aperture provided in the relay receptacle allows said tabs to be inserted only into specified terminal slots of the relay receptacle;

a conductor plate including a link portion, said plurality of tabs projecting from said link portion; and a cover covering said link portion;

wherein said post member is integrally formed with said cover and extends from said cover in substantially the same direction as said tabs; and wherein said cover is formed of an insulating synthetic resin.

8. The shorting terminal according to claim 7, wherein said post member projects beyond said tabs.

9. The shorting terminal according to claim 7, wherein said link portion of said shorting terminal attaches to said cover through a locking mechanism.

10. The shorting terminal according to claim 7, wherein the post aperture is rectangular in shape and said post member is rectangular in cross section, such that said post member cannot be inserted into the post aperture if rotated 90 degrees.

11. The shorting terminal according to claim 7, wherein the post aperture is L-shaped in cross section, such that said post member cannot be inserted into the post aperture if rotated 90 degrees.

12. The electrical connector box according to claim 7, wherein said link portion of said shorting terminal is mold formed therein.

* * * * *